US010221513B2

(12) United States Patent
Visentin

(10) Patent No.: US 10,221,513 B2
(45) Date of Patent: Mar. 5, 2019

(54) TEXTILE MANUFACTURED PRODUCT MADE USING EMBROIDERY MACHINES

(71) Applicant: RICAMIFICIO GEA SNC, Bolladello di Cairate (Varese) (IT)

(72) Inventor: Fabio Visentin, Bolladello di Cairate (IT)

(73) Assignee: RICAMIFICIO GEA SNC, Bolladello di Cairate (IT)

( * ) Notice: Subject to any disclaimer, the term of this patent is extended or adjusted under 35 U.S.C. 154(b) by 822 days.

(21) Appl. No.: 14/420,058

(22) PCT Filed: May 20, 2013

(86) PCT No.: PCT/IB2013/054141
§ 371 (c)(1),
(2) Date: Feb. 6, 2015

(87) PCT Pub. No.: WO2014/024054
PCT Pub. Date: Feb. 13, 2014

(65) Prior Publication Data

US 2015/0211162 A1 Jul. 30, 2015

(30) Foreign Application Priority Data

Aug. 9, 2012 (IT) ..... MI2012A1420

(51) Int. Cl.
*D05C 17/00* (2006.01)
*D05C 7/08* (2006.01)

(52) U.S. Cl.
CPC ..... *D05C 17/00* (2013.01); *D05C 7/08* (2013.01)

(58) Field of Classification Search
CPC ..... D05C 17/00; D05C 7/08
USPC ..... 112/404, 413, 415–417, 429, 439
See application file for complete search history.

(56) References Cited

U.S. PATENT DOCUMENTS 4,516,609 A * 5/1985 Dennis ..... D03D 9/00 112/439
6,263,817 B1 * 7/2001 Tajima ..... D05C 17/00 112/439
2005/0153614 A1 7/2005 Dohler
2007/0204783 A1 9/2007 Chong
2008/0173223 A1 * 7/2008 Butcher ..... A61B 17/7059 112/475.18

(Continued)

FOREIGN PATENT DOCUMENTS

EP 2045387 A1 4/2009
FR 2862666 A1 5/2005

(Continued)

*Primary Examiner* — Nathan Durham
(74) *Attorney, Agent, or Firm* — Pearne & Gordon LLP

(57) ABSTRACT

A textile manufactured product made using embroidery machines comprises a base structure made of thread-like and/or ribbon-like elements which are made of at least one first material and also comprises at least one thread-like and/or ribbon-like ornamental element made of at least one second material which is different to the first material in terms of mechanical strength and reflection/refraction of the light; the thread-like and/or ribbon-like ornamental element is connected to said base structure by means of a plurality of knots which are positioned at predetermined intervals along the thread-like and/or ribbon-like elements made of the first material.

5 Claims, 1 Drawing Sheet

(56) References Cited

U.S. PATENT DOCUMENTS

| | | | | |
|---|---|---|---|---|
| 2008/0178786 | A1 | 7/2008 | Butcher | |
| 2010/0089297 | A1* | 4/2010 | Butcher | D05C 7/00 112/440 |
| 2012/0260838 | A1* | 10/2012 | Matsuhiro | D05B 35/06 112/475.18 |

FOREIGN PATENT DOCUMENTS

| | | | |
|---|---|---|---|
| IT | MI911679 | B | 1/1995 |
| JP | 2002069814 | A | 3/2002 |

* cited by examiner

TEXTILE MANUFACTURED PRODUCT MADE USING EMBROIDERY MACHINES

FIELD OF THE INVENTION

This invention relates to a textile manufactured product made using specific embroidery machines, and also having a special knit structure.

DESCRIPTION OF RELATED ART

As is known, making textile manufactured products according to the technological specifications of current embroidery machines allows the definition of special knit patterns, which in general are made using textile fibres which are in general the same in terms of type, weft and warp.

The above-mentioned prior art, although widely used, has several disadvantages, both in terms of the intrinsic delicacy of the manufactured products obtained using embroidery machines, and because of the aesthetic visual limitations that prior art embroidered products have as seen by the user (but also and above all as seen by the fashion operator who must "assemble" said embroidered products to form a complete item of clothing or a complex clothing accessory).

For example, the prior art knit patterns of manufactured products made using embroidery machines may be too delicate or in any case unable to withstand significant stresses (for example, pulling or "crumpling"), or in any case cannot be made very strong if a quite loose knit structure is to be obtained (which is precisely one of the visual features desired when making embroidered manufactured products).

Similarly, using a known type of fibres, it is not possible to give the manufactured product special optical properties, such as a certain shine or a considerable capacity for "treating" incident light in terms of refraction and/or reflection (for example, to make the manufactured product shinier or even to give it a metallic or in any case glossy appearance).

This invention therefore aims to provide a manufactured product made using embroidery machines which can overcome the above-mentioned drawbacks.

The main aim of this invention is to provide a manufactured product made using embroidery machines which at the same time has greater mechanical strength and an aesthetic—visual appearance which cannot be reproduced by the prior art.

This invention also aims to provide a manufactured product made using embroidery machines which can have special optical properties in terms of reflection and/or refraction of the light, so that it can have an innovative appearance compared with manufactured products made using the embroidery machines currently known.

Therefore, the aim of this invention is to provide a manufactured product which can be made on specific embroidery machines, and which can also rapidly and with simple actions on the machines be set up with various alternative weaves.

SUMMARY OF THE INVENTION

The technical purpose indicated and the aims specified are substantially achieved by a textile manufactured product made using embroidery machines having the features described in one or more of the appended claims.

DETAILED DESCRIPTION OF THE INVENTION

Figure 1:
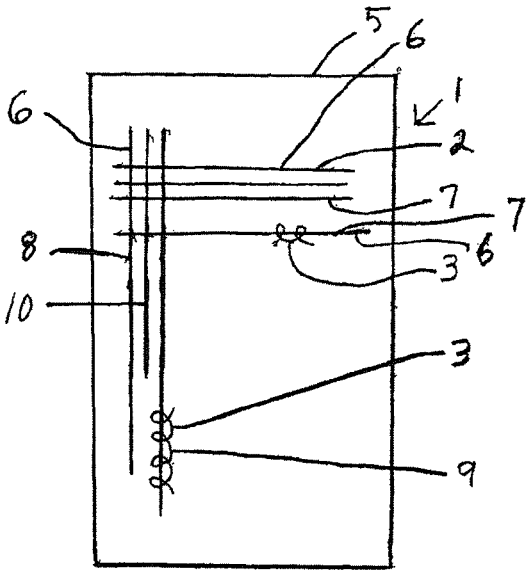
FIG. 1 schematically shows a manufactured product 1 according to the invention.
Figure 2:
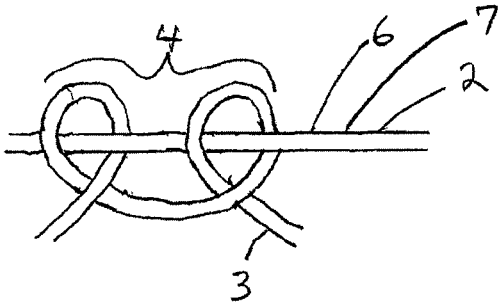
FIG. 2 shows a portion of the manufactured product 1 of FIG. 1.
Figure 3:
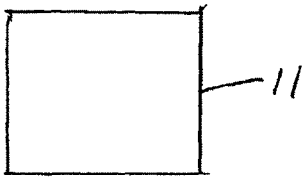
FIG. 3 shows schematically an embroidery machine 11.

With reference to FIGS. 1-3, there is shown a manufactured product 1 comprising a base structure 5 which comprises thread-like or ribbon-like elements 6, which can be weft threads 7 and warp threads 8. The thread-like or ribbon-like ornamental element 3 can form an ornamental pattern 9. A third material 10 is also shown.

A manufactured product according to the invention will now be described by way of example and without limiting the scope of the inventive concept.

The manufactured product according to this invention is specifically made using embroidery machines and comprises a base structure made of thread-like elements (and/or even ribbon-like elements, depending on requirements) which are made of at least one first material 2 having suitable mechanical and optical properties.

Advantageously, and unlike prior art manufactured products made using embroidery machines, this textile manufactured product also comprises a thread-like (and/or ribbon-like, again depending on requirements) ornamental element 3: said ornamental element 3 being made of at least one second material which is different to said first material in terms of mechanical strength and reflection/refraction of the light.

Thanks to the different mechanical and optical features, the base structure of this manufactured product may therefore have the function of strengthening the manufactured product, and at the same time it can have the function of "optical treatment" acting on the incident light, reflected and/or refracted on the manufactured product.

In addition to the functions of the base structure, the thread-like and/or ribbon-like ornamental element 3 is connected to the base structure by a plurality of knots 4 which are positioned at predetermined intervals along the thread-like and/or ribbon-like elements made of the "first material": by suitably selecting the type of knots and the distance between the knots, a distinctive aesthetic effect is obtained and also substantial stability of shape and connection between the ornamental element and the base structure.

Looking in detail at how the invention is made, it should be noticed that depending on requirements the base structure may be organised in weft threads and warp threads which are connected to each other, or more in general, if the intention is to create special effects or fabrics, the base structure may form an embroidered ornamental pattern: said ornamental pattern is appropriately produced using an embroidery machine, preferably designed to perform macramé work.

In terms of the choice of materials, and therefore differentiation of the mechanical and optical properties of the base structure relative to the ornamental thread and/or ribbon, in this manufactured product the "first material" may be completely made of polyamide (for example, a nylon with a count equal to 150 denier and/or having an average yarn diameter equal to 0.14 millimeters).

At this point it should be noticed that the choice of polyamide/nylon in manufactured products made using embroidery machines is an innovative element compared with the above-mentioned prior art, and allows great mechanical strength to be obtained combined with an equally original way of reflecting and refracting light, which in turn gives this invention a very special aesthetic—visual appearance.

In contrast, regarding the possible choices of "second material", this invention may involve the use of cotton (for example, a cotton thread made using two threads which are twisted together and having an overall diameter of between 20 and 80 microns, and preferably equal to 60 microns), of silk (for example a silk having a twisted and/or discontinuous thread structure and a "metric count" equal to 200,000) or a lamé and/or a Lurex (fabric with metallic appearance) (for example, a lame and/or a Lurex (fabric with metallic appearance) twisted with at least one polyamide thread and comprising between 10% and 28% polyamide by weight and between 90% and 72% viscose by weight).

In the spirit of this invention, regarding materials eligible for making the ornamental element 3 obviously there are many possible choices outside of the examples listed above, provided that it is optically and structurally different to the material selected for the base structure of the manufactured product 1.

To provide a simple explanation of the above, for example it is possible to make manufactured products which have the following combinations of fabrics:

- the first material comprises a cotton, whilst the second material comprises a polyamide;
- the first material comprises a cotton, whilst the second material comprises a polyester;
- the first material comprises a cotton, whilst the second material comprises a silk;
- the first material comprises a cotton (typically equal to 85% of the weight of the entire manufactured product), whilst the second material comprises a cashmere (typically equal to 15% of the weight of the manufactured product).

With reference to the last example combination mentioned above, according to the invention it is possible to make a manufactured product which comprises three different groups of threads: for example, a third material may be present, knitted into the weft and/or warp of the first and/or the second material, which in turn may be a polyamide.

From the structural viewpoint, the base structure may comprise a single thread or two, three or four threads which are substantially parallel with one another. If two or more threads are used, one of them must always be made of a polyamide/nylon whilst the other one, two or three threads (and/or ribbons) may suitably be made of cotton.

Focusing attention on the knots 4, it may be seen how they can be spaced out, on the base structure, by an interval of between 1 and 5 millimeters, and preferably they are spaced at 3 millimeters from each other.

The type of knots which can be made is suitably variable depending on the embroidery machines used to make this manufactured product, and it may also be the case that in a base structure with two or more threads the knots can be made in such a way as to form stretches of thread and/or ribbon which are alternatively positioned in opposite half-spaces relative to the ideal lying plane of the threads and/or ribbons forming the base structure.

Alternatively, for a base structure with a single thread and/or ribbon (for example, where only the nylon thread is present), it may be seen how the ornamental thread and/or ribbon 3 always remains substantially in the same half-space relative to the ideal lying plane of the threads and/or ribbons which form base structure.

This invention also relates to a method for making a textile manufactured product on embroidery machines (of the type designed to perform macramé work): said method is therefore specifically designed for making a manufactured product according to what is described above (and in the claims below) and mainly comprises the following steps:

- first, weaving a temporary base structure, which may be organised in weft and warp and/or according to a predetermined ornamental pattern: said temporary base structure comprises a predetermined number of thread-like and/or ribbon-like elements made of at least one first material 2 (which will therefore form the "definitive" base structure of the finished manufactured product 1 according to the invention) and at least one thread-like and/or ribbon-like element made of an expendable material (for example, an acetate or more generally a textile material which is known by experts in the field as "chemically manufactured");
- associating with said temporary base structure at least one thread-like and/or ribbon-like ornamental element 3, which is suitably made of at least one second material which is different to the material used to make the base structure (both the "temporary" and the "definitive" one) in terms of mechanical strength and reflection/refraction of the light; and finally
- destroying (for example by chemically dissolving in solvent and/or by pyrolysis) the thread-like and/or ribbon-like element made of expendable material, in such a way as to obtain a definitive base structure which is interconnected with the thread-like and/or ribbon-like ornamental element 3.

Appropriately, the step of associating the thread-like and/or ribbon-like ornamental element 3 with the temporary base structure comprises a sub-step of making a plurality of knots 4 which are positioned at predetermined intervals along the temporary base structure; said knots can be made simultaneously with the step of defining/making the temporary base structure.

The Invention Brings Many Advantages.

In fact, thanks to the special construction architecture of the manufactured product, it is possible to obtain significant mechanical features without being forced to have high a density knit. That allows the production of very "open" structures, and therefore preserves the typical appearance of embroidered manufactured products, combining this look with the ability to withstand pulling/jerking/cutting which is definitely not encountered with conventional embroidered products.

At the same time, the special method of interconnecting the elements of which the knit structure of this manufactured product is composed allows a high level of consistency and retention of both the knit structure and the appearance, as well as a special visual aspect (given by the sequence of knots alternating between the supporting structure and the ornamental thread) not found in the prior art.

Moreover, the special choice of materials which can be used to make the supporting structure gives the embroidered manufactured product special optical properties, which in turn translate into a metallic sheen/reflective/shiny appearance of the whole product which cannot be achieved in prior art manufactured products.

Moreover, in terms of the production method, the use of embroidery machines allows an extremely wide freedom of choice of the knit structures, which is advantageously combined with reduced times for re-setting the machines. This means that highly variable requirements can be met in very short timescales and therefore, plant productivity and flexibility are maximised.

Lastly, it should be noted how this invention allows the production costs of the manufactured product to be kept low, as well as not causing particular complications or modifications and retro-fitting adaptations on prior art machinery or systems, with advantages in terms of the overall production cost and the final price of the product.

The invention claimed is:

1. A method for making a textile manufactured product on embroidery machines comprising the following steps:

weaving a temporary base structure organised in weft and warp comprising threads and/or ribbons, said threads and/or ribbons being made of at least one first material, and at least one thread or ribbon being made of an expendable material;

connecting with said temporary base structure at least one thread or ribbon ornamental element made of at least one second material which is different to said first material in terms of mechanical strength and reflection/refraction of the light, said step of connecting the thread or ribbon ornamental element with the temporary base structure comprising a sub-step of making a plurality of knots positioned at intervals along the temporary base structure; and destroying said thread or ribbon made of expendable material, in such a way as to obtain a definitive base structure which is interconnected with the thread or ribbon ornamental element.

2. A textile manufactured product made using embroidery machines, comprising a base structure made of threads and/or ribbons, said threads and/or ribbons being made of at least one first material, said textile manufactured product being characterised in that it also comprises at least one thread or ribbon ornamental element made of at least one second material which is different to said first material in terms of mechanical strength and reflection/refraction of the light, said thread or ribbon ornamental element being connected to said base structure by means of a plurality of knots which are positioned at intervals along said threads and/or said ribbons made of at least one first material; wherein said first material consists entirely of polyamide, wherein said second material comprises a lame and/or a fabric with metallic appearance, wherein said lame and/or said fabric with metallic appearance are twisted with at least one polyamide thread, and wherein said lame and/or said fabric with metallic appearance are polyamide at between 10% and 28% by weight and viscose at between 90% and 72% by weight.

3. A method for making a textile manufactured product on embroidery machines comprising the following steps:

weaving a temporary base structure organised in weft and warp comprising threads and/or ribbons, said threads and/or said ribbons being made of at least one first material consisting entirely of polyamide, and at least one thread or ribbon element made of an expendable material;

connecting with said temporary base structure at least one thread or ribbon ornamental element made of at least one second material which is different to said first material in terms of mechanical strength and reflection/refraction of the light, said step of connecting the thread or ribbon ornamental element with the temporary base structure comprising a sub-step of making a plurality of knots positioned at intervals along the temporary base structure; and destroying said thread or ribbon element made of expendable material, in such a way as to obtain a definitive base structure which is interconnected with the thread or ribbon ornamental element.

4. The method according to claim 3, said definitive base structure forming an embroidered ornamental pattern.

5. The method according to claim 4, wherein said embroidered ornamental pattern is made using an embroidery machine.

* * * * *